US006371142B1

(12) United States Patent
Battiston

(10) Patent No.: US 6,371,142 B1
(45) Date of Patent: Apr. 16, 2002

(54) SEATED WALKER

(75) Inventor: Joseph Battiston, Chester, VA (US)

(73) Assignee: Tubular Fabricators Industry, Petersburg, VA (US)

( * ) Notice: Subject to any disclaimer, the term of this patent is extended or adjusted under 35 U.S.C. 154(b) by 0 days.

(21) Appl. No.: 09/356,829

(22) Filed: Jul. 19, 1999

(51) Int. Cl.[7] ..... A61H 3/00

(52) U.S. Cl. ..... 135/67; 135/66; 297/6; 297/339

(58) Field of Search ..... 135/67, 66, 65; 297/6, 5, 13, 196, 311, 339

(56) References Cited

U.S. PATENT DOCUMENTS

| | | | | |
|---|---|---|---|---|
| 1,448,783 A | | 3/1923 | Blewitt et al. | |
| 2,798,533 A | * | 7/1957 | Frank | 135/67 X |
| 3,354,893 A | | 11/1967 | Schmerl | |
| 4,162,101 A | * | 7/1979 | McCague, Sr. et al. | 135/67 X |
| 4,518,002 A | | 5/1985 | Battiston | |
| 4,619,282 A | | 10/1986 | Battiston | |
| 4,907,839 A | * | 3/1990 | Rose et al. | 135/67 X |
| 5,224,721 A | | 7/1993 | Santmann | |
| 5,353,824 A | | 10/1994 | Woods et al. | |
| 5,558,358 A | | 9/1996 | Johnson | |
| 5,605,169 A | | 2/1997 | Light | |
| 5,816,983 A | | 10/1998 | Dawes et al. | |
| 5,904,168 A | | 5/1999 | Alulyan | |

OTHER PUBLICATIONS

Wheeled Walking Frames. Catalogue [online]. Daily Living Products, Dec. 1998 (page 2 of 3) [retrieved on Mar. 6, 1999]. Retrieved from the Internet: URL="http://www.ca-.com.au/daily/wheels.html".

Carex Healthcare Products, Seat Walkers in "Step 'N Rest" series catalogue, 1992. pp. 28–29.

Catalog: TFI Health Care, 1996, p. 6.

* cited by examiner

*Primary Examiner*—Daniel P. Stodola
*Assistant Examiner*—Erica B. Harris
(74) *Attorney, Agent, or Firm*—Klauber & Jackson

(57) ABSTRACT

A seated walker has a frame that includes pair of inverted U-shaped side members and a cross bar. A seat is pivotally affixed to the frame and is movable between an upper position where the seat is generally vertical and out of the way of the user and a lower position where the seat is generally horizontal and can be utilized by the user to sit down. An elastic cord is affixed to the frame of the seated walker and encircles the seat so that the seat is biased toward its upper position. By use of the elastic cord, a user can disable the biasing function by hand to remove the elastic cord from encircling the seat and, engage the biasing. Thus, the user can use or not use the biasing function as desired. As a further feature, the seat can be pivotally affixed to a front cross bar and is supported by a pair of generally L-shaped members extending outwardly from the underside of the seat and which rest upon pair of side braces that are positioned lower on the frame than the front cross bar. Thus, the side braces can be positioned low to optimize the bracing of the side frame members and yet the seat can be at a higher distance from the ground.

14 Claims, 5 Drawing Sheets

SEATED WALKER

FIELD OF THE INVENTION

The present invention relates generally to invalid devices and, more particularly, to an invalid device that serves as a walker and additionally has a seat that is accessible by the user as desired.

BACKGROUND OF THE INVENTION

Typically, walkers are used by the elderly or invalid persons to assist in the ambulation process, that is, to enable such person to be able to walk certain distances on their own. Such walkers are quite common and, in general most commonly have a pair of side frames, generally configured as A-shape or inverted U-shape and which are joined together with one or more cross-members so that the walker is sufficiently strong to support the person. The side frames include legs that extend downwardly to contact the ground for support of the walker as the person ambulates.

Thus the upper portion of the side frames is a horizontal section that can be gripped by the user so that the walker can be used for the support as well as progressed forwardly by the user at each step. Preferable the overall unit can be formed of a tubular metal, such as aluminum, and the various components welded together to provide the necessary strength.

One of the features of some of the current walkers is the addition of a seat that can be moved into a horizontal position by the user so that the user can, as desired, sit down to rest or as needed in the event of a medical need. It is obviously important that the seat be readily available to the user when needed and yet be fully out of the way when the user is utilizing the walker to move from one location to another.

Thus, typically, the seat may have one side pivotally affixed to some member of the walker and the opposite side thereof free such that the seat may be pivoted downwardly to a generally horizontal position when needed for the user to sit down and be as easily again pivoted to an upward position out of the way when the user is trying to walk.

It has been known to provide a spring bias to the seat so that it will immediately move to its upright or vertical position when the person is not actually using the seat and, at times, that biasing can be a convenience to the user. An example of a spring biased seat is shown and described in U.S. Pat. No. 3,354,893 of Schmerl where a spring is provided to automatically return the seat to its upright vertical position. There are times, however, that the user does not want to utilize a spring biasing and would prefer that the seat remain in its lower, horizontal position so that the user can be assured that the seat will not spring to its upper, unusable position as soon as the user stands up. Thus the user is assured that when again sitting down, the seat has not automatically been moved by the spring bias to the upper position and the user can be injured by not recognizing the seat is no longer its lower, sitting position. With the Schmerl type of construction, it is not possible to readily disable the spring biasing, particularly during the use of the walker and by a person likely to have diminished physical capabilities.

Accordingly it would be advantageous for the user to be able to have the'spring bias to automatically return the seat to its vertical, upper position but, as desired, be able to disable the spring bias whenever the user desires. Since the user is invariable an elderly or informed individual, the enabling and disabling of the bias on the seat must, of course, be some mechanism that can be easily handled by such a person. Thus, it would be particularly desirable if the feature that allowed the user to enable and disable the spring bias on the seat be relatively simple and not require any complex dexterity of the user so that the process can be readily accomplished by an elderly or informed person with limited physical dexterity.

In addition, in the construction of seated walkers, there is generally a side brace that joins the two legs of each of the side frames. That side brace is important to provide the structural strength and integrity of the overall walker and, accordingly, it is preferable to that structural integrity that the side brace be located at a low position joining the legs, that is, that the brace be relatively close to the ground that is contacted by the legs in utilizing the walker.

The braces, however, are also a convenient structural component to use as support for the seat when it is pivoted to its lower, horizontal position. Therefore, there is a conflict in the construction. It is certainly advantageous for the seat to be supported by the side braces, but the design goal of positioning those side braces as low as possible would normally result in the seat being too low to be comfortable and convenient for the user. A low positioned seat, obviously, makes it difficult for the user to be able to sit and arise without difficulty. Thus, it would be advantageous to be able to construct a walker where the side braces are sufficiently low so as to optimize the structural integrity and strength of the walker, and yet allow the seat, when in its horizontal position to oriented sufficiently high so that the user can comfortably sit and stand without difficulty.

SUMMARY OF THE INVENTION

Therefore, in accordance with the present invention, a seated walker is provided that overcomes the difficulties and problems of the aforedescribed walkers and which has a frame having a pair of generally inverted U-shaped side members that are braced by side braces to insure the integrity and strength of the overall walker construction and a front cross bar joins the side members and maintains those side members in their upright position. A seat is pivotally affixed to the frame such that it can be moved between its upper position where it is generally vertically oriented and its lower position where the seat is generally in a horizontal orientation so that the user can comfortably sit on the seat. In the preferred embodiment, one side of the seat is pivotally affixed to the front cross bar and thus the opposite side, a free side, is movable in order to carry out the pivoting movement.

When in the lower, generally horizontal position, the seat is supported by the side braces by means of a pair of oppositely positioned L-shaped members that extend downwardly from the seat and which engage the side braces to support the seat. The L-shaped members extend a predetermined finite distance downwardly from the seat such that they can contact and be supported by the side braces and yet the seat itself can be maintained sufficiently high for the comfort and ease of the user in sitting and standing. In addition, with the use of the downwardly extended L-shaped members, the seat, when in its upper position, can be sufficiently moved to a position where it is out of the way of the user to allow the user optimum room to move as that user ambulates by means of the walker.

Further, the present seated walker includes a biasing means that biases the seat toward its upper, vertical position. That means is an elastic cord that is affixed to the walker, preferably to the front cross bar and which can be easily positioned by the user to encircle at least a portion of the seat to create the bias. In the event the user wants to disable the bias, it is a simple matter to remove the elastic cord from its position encircling at least a portion of the seat such that the cord can hang free and not contribute any bias to the seat. Accordingly, the elastic cord can be easily manipulated by even an informed or elderly user since it does not require considerable dexterity to enable and disable the elastic cord.

In the preferred embodiment, the elastic cord encircles the entire free side of the seat so that the cord can readily be manipulated to its biasing position about the seat. As a further feature in the preferred embodiment, there are tubular bars that extend along the sides of the seat and which capture the elastic cord when it is positioned around the free side of the seat. Thus, since the seat itself is normally covered by a suitable material to make the seat comfortable to the user, the seat covering material is also normally wearable and the continued movement and rubbing of the elastic cord against the wearable material of the seat can cause damage to that material and shorten its lifetime.

The tubular bars thus capture the elastic cord and that cord rides along the tubular bars rather than contact along the seat material. In such manner, the seat material is protected from the wear that would otherwise be occasioned by the friction and constant rubbing between the elastic cord and the wearable material covering the seat.

Other features and advantage will become apparent to those skilled in the art from a review of the ensuing description while proceeds with reference to the following illustrative drawings.

DETAILED DESCRIPTION

Figure 1:
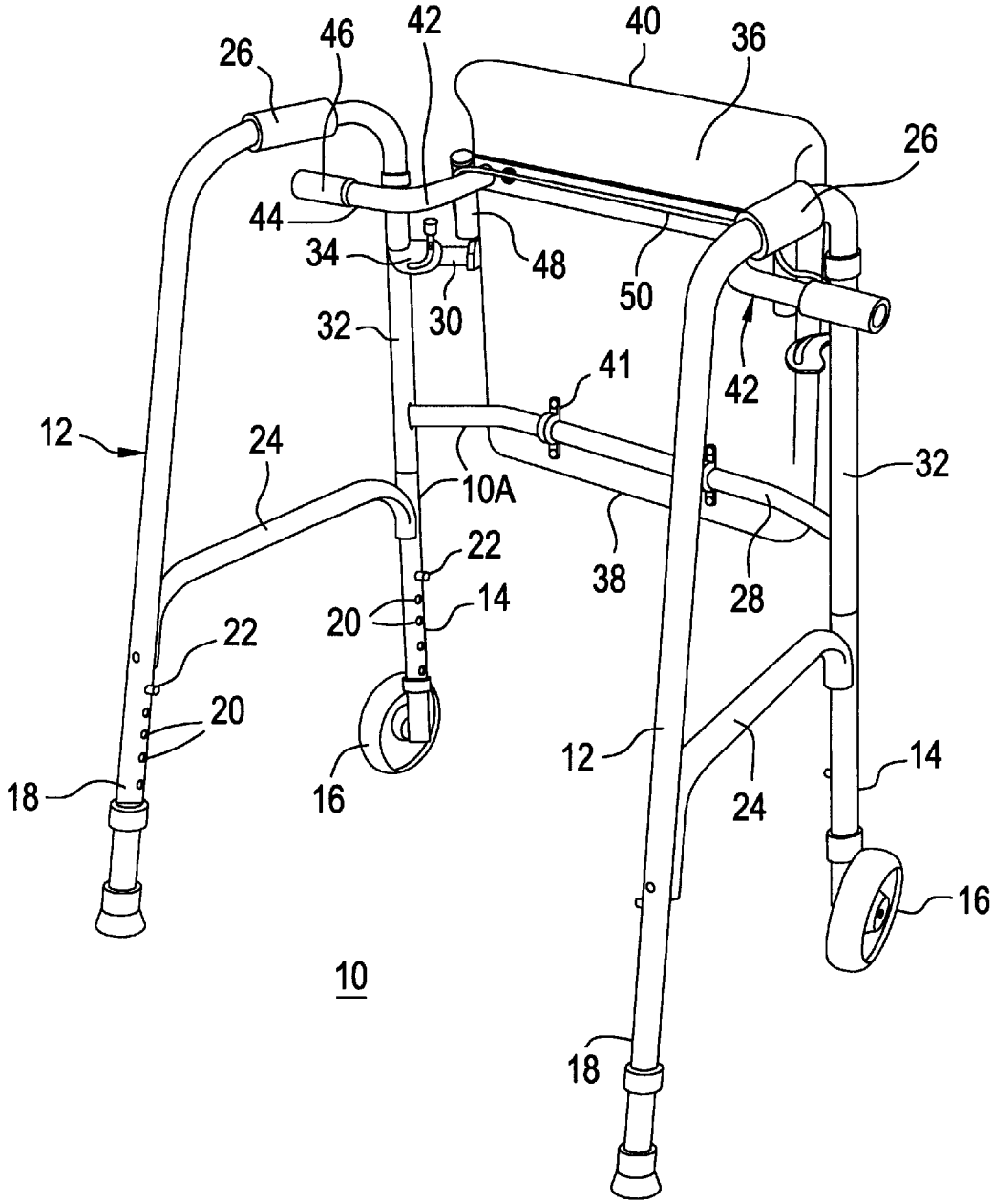
FIG. 1 is a perspective view of a seated walker constructed in accordance with the present invention.

Referring now to FIG. 1, there is shown a perspective view of a seated walker 10 constructed in accordance with the present invention. As can be seen, the seated walker 10 comprises a frame 10A comprising a pair of inverted U-shaped side members 12 that are spaced apart to provide room for the user to stand in utilizing the apparatus and at least one crossbar 22. As used herein, by convention, the front of the walker 10 will be referred to as the direction the user is ambulating when using the walker 10 and thus, in FIG. 1, the U-shaped members 12 are shaped so as to include front legs 14 that may have wheels 16 to make the movement of the walker 10 easier for the user and rear legs 18. Both the front legs 14 and the rear legs 18 may be adjustable for height to suit the individual user and such means may be a plurality of holes 20 in the front and rear legs 14, 18 where a spring loaded button 22 can emerge to lock the legs into the desired height.

Side braces 24 are affixed to the front and rear legs 14, 16 to provide support for the legs and, as will be explained, it is desirable for the side braces 24 to be positioned relatively low, that is, fairly close to the ground to optimize the effectiveness of the bracing function. At the upper portion of the side members 12, there is a generally horizontal portion and may include a grip 26 that is held by the user to control and use the seated walker 10. A lower and upper cross bar 28 and 30, respectively, join the side members 12 at the front thereof and which serve to support the side members 12 so that the overall walker has sufficient strength and integrity for its intended purpose.

As also can be seen, the side members 12 are both movable and are pivotally affixed to a fixed member 32 so that the side members 12 can be rotated from the position shown in FIG. 1 to a collapsed or close position. A locking mechanism 34 allows the side members 12 to be rotated in the open position shown in FIG. 1 and to release the side members 12 when it is desired to collapse the seated walker 10. The locking mechanism 34 is more fully shown and described in U.S. Pat. No. 4,518,002 owned by the same assignee as the present application.

A seat 36 is provided and is pivotally affixed to the lower cross bar 28 so that one side of the seat 36 is movably fixed while the opposite free side 40 can be rotated about the lower cross bar 28. As shown, the actual means to carry out the affixation of the seat 36 to the lower cross bar 28 may be by the use of C-clamps 41 that are affixed to the underside of the seat 36. As will become clear, the seat 36 may have a solid frame and may be covered with a material for the comfort of the user. The material may be a variety of differing materials and one preferred material is a plastic vinyl material.

Depending outwardly from the underside of the seat 36 is a pair of generally L-shaped curved members 42, which extend downwardly and outwardly. The purpose of the curved members will later be explained, it being sufficient to note that the outer leg 44 of the curved members is located a predetermined, finite distance from the underside of the seat 36. A resilient cylindrical pad 46 may be affixed to the end of the outer leg 44. Also located on the underside of seat 36 are tubular bars 48 that may be affixed by welding or the like to the curved members 42.

Finally, with reference to FIG. 1, there is an elastic member, shown as elastic cord 50 that, as shown, has its ends affixed to the walker 10 and which encircles the free side 40 of seat 36. In the preferred embodiment, the ends of the elastic cord 50 can be affixed to the upper cross bar 30, however, the ends may be affixed to other fixed locations on the seated walker 10. Thus, the elastic cord 50 encircles the free side 40 of seat 36 such that it is captured by the tubular bars 48 by passing over those tubular bars 48 and around the curved members 42.

As can be seen, therefore, as the free side 40 of the seat 36 is moved downwardly, the elastic cord 50 stretches and thus creates an increasing bias on the seat 36 to urge the seat 36 back toward its upper position as shown in FIG. 1.

Figure 2A:
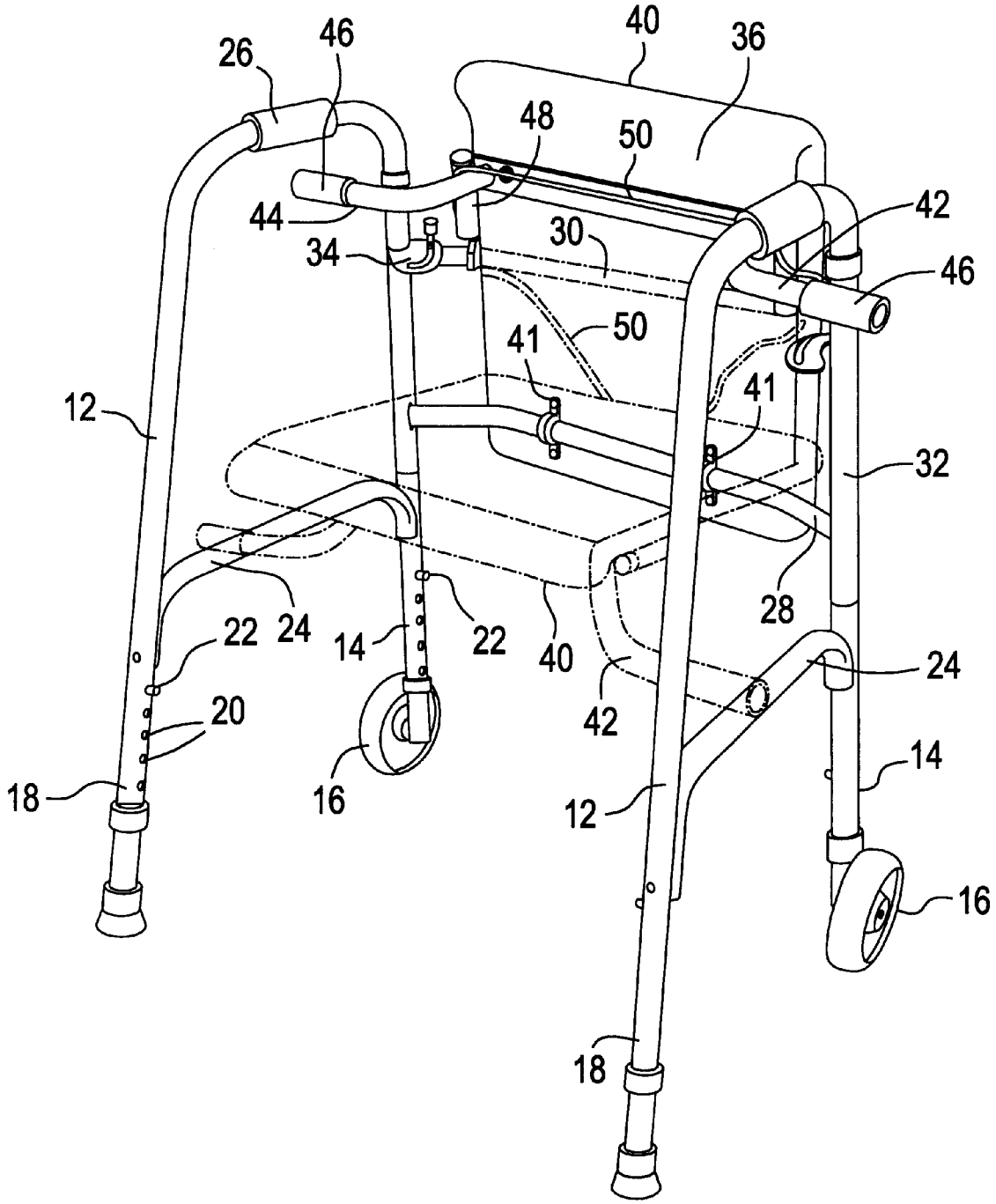
FIG. 2A is a perspective view of the seated walker of FIG. 1 showing the seat in its lower position by phantom lines.

Turning now to FIG. 2A, there is shown a perspective view of the seated walker 10 as described with the seat 36 shown in its lower position in phantom lines. Taking the phantom, lower position, it can be seen that the curved members 42 rest on the side braces 24 and thus support the seat 36 in this position. As will be farther become clear, the use of the curved member 42 allows the seat to be oriented in a higher position than if the seat 36 were itself resting on the side braces 24. Thus, to aid in the strength and integrity of the seated walker 10, the side braces 24 can be kept low, close to the ground where they provide the optimum strength to brace the side frame members 12 yet, the seat 36 is kept at a higher level from the ground to make it easier for the user to sit and arise from the seat 36.

As is also shown in FIG. 2A, the elastic cord 50 has been disengaged from its position of FIG. 1 where it encircled the free side 40 of seat 36 such that it simply hangs down from its points of attachment to the upper cross bar 30. As such, in the lower, phantom position of the seat 36 in FIG. 2A, the spring bias that would bias the seat 36 toward its upper position has been disengaged so there is no bias and the seat 36 can thus remain it its lower position. Therefore, by simply pulling the elastic cord 50 away from its engagement with the seat 36, the user can disengage the bias and the seat 36 will remain in its lower position. In this manner, the user can easily decide whether to use the biasing feature or not, and if the user desires to leave the seat 36 in its lower position, the user simply pulls the elastic cord 50 free from the seat 36. The engaging and disengaging of the bias is therefore quite easy and can be carried out by a disabled or elderly person since it does not require any great amount of manual dexterity to engage or disengage the elastic cord 50 from the seat 36.

Figure 2B:
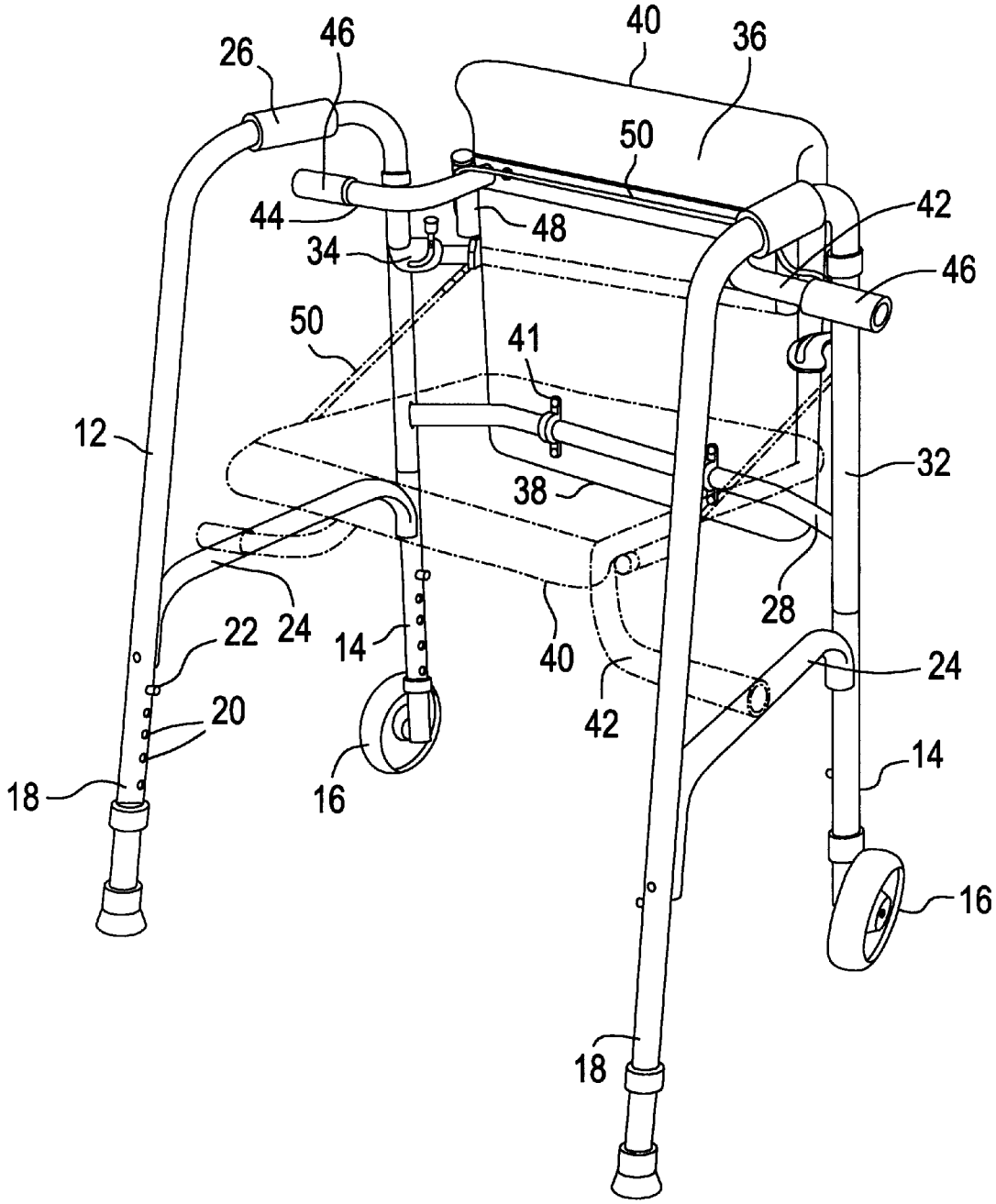
FIG. 2B is a further perspective view of the seated walker of FIG. 1 showing the seat in it lower position by phantom lines.
Figure 3:
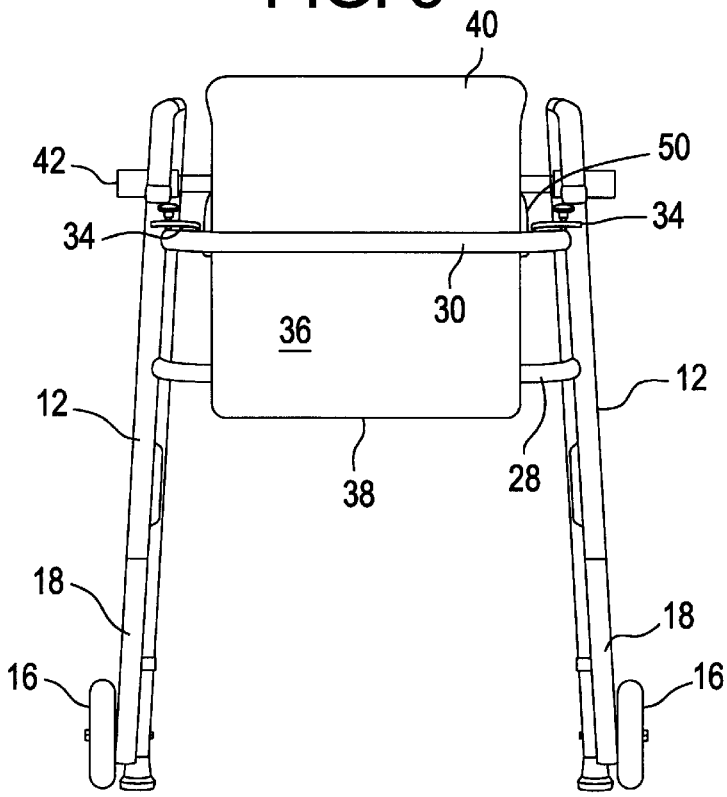
FIG. 3 is a front plan view of the seated walker of the present invention.

Turning now to FIG. 2B, there is shown a perspective view of the seated walker 10 with the seat in its lower position in phantom lines. Thus, in the phantom, lower position, it can be seen that the elastic cord 50 encircles around the free side 40 of the seat 36 and thus the seat 36 is biased toward its upper position. In this mode, obviously, if the user arises from the seat 36, that seat 36 will immediately be biased to the upper position. As can also be seen, the function of the tubular bar 48 is to hold the elastic cord 50 from rubbing against the material of seat 36 as the seat 36 is moved between its upper and lower positions. As shown, the tubular bars 48 are cylindrical tubes, however, they can be in any variety of configurations that are elongated and that capture the elastic cord 50 to prevent that elastic cord 50 from damaging the material covering Turning now to FIG. 3, there is shown a front view of the seated walker 10 constructed in accordance with the present invention. In this figure, it can be seen that the seat 36 is in its upper position held against the upper cross bar 30 by the elastic cord 50. In this position, of course, the user can stand up and direct the walker as desired and the seat 36 is out of the way of the user.

Figure 4:
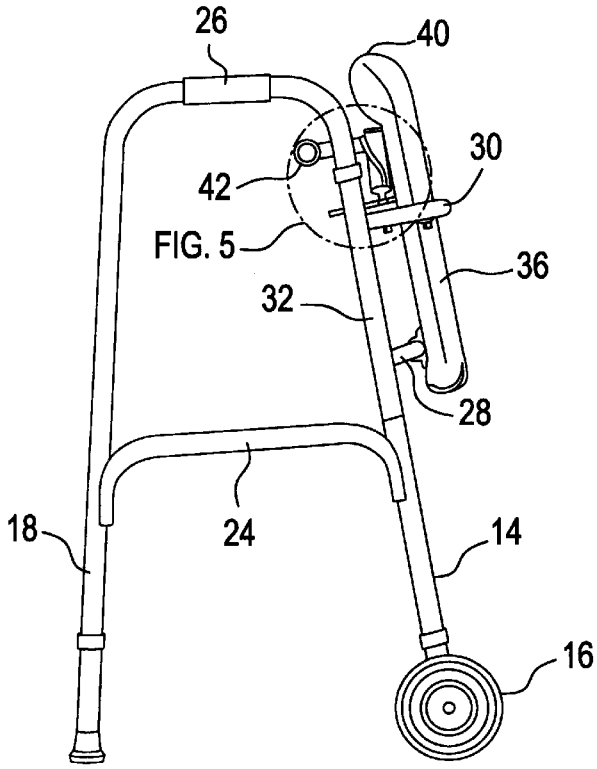
FIG. 4 is a side plan view of the seated walker.

In FIG. 4, there is shown a side view of the seated walker 10, again showing the seat 36 in it upper position where it is substantially vertically oriented. In this figure, the height of the seat 36 can be appreciated, that is, the seat 36 is pivotally mounted to the lower cross bar 28 that is a finite distance higher in elevation from the ground than the side brace 24. Thus, by use of the curved members 42 that extend from the underside of the seat 36, it is possible to have the height of the seat 36 located above the ground at a convenient height for the user while maintaining the height of the side braces 24 at a lower elevation with respect to the ground where the side braces 24 can better provide bracing stability to the side frame members 12 and the front and rear legs 14, 18.

Figure 5:
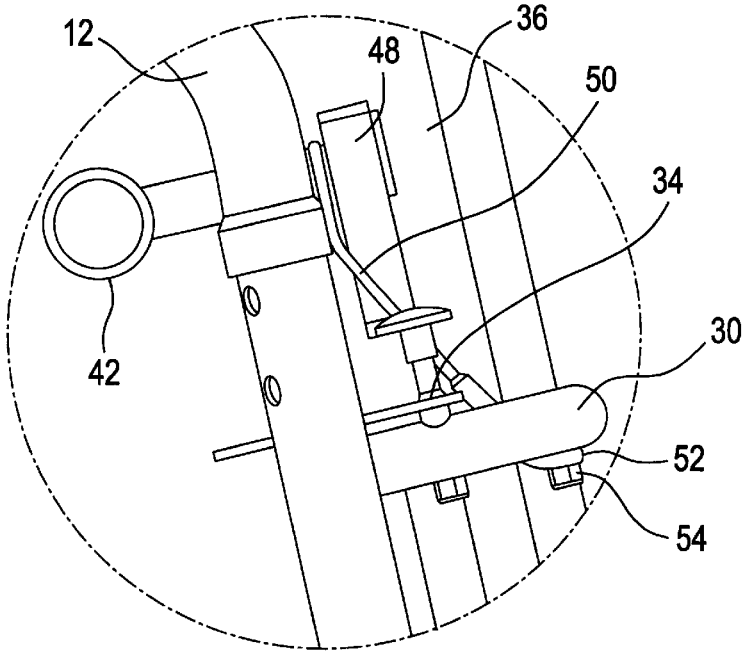
FIG. 5 is a enlarged view of the designated portion of the seated walker of FIG. 4.

In the enlarged view of FIG. 5, there is shown a view of that portion of the seated walker 10 specified in FIG. 4 and showing the elastic cord 50 interfitted around the curved member 42 and resting along the tubular bar 48 so that the elastic cord 50 cannot ride along or rub against the material of the seat 36 as the seat 36 is moved between its upper and its lower positions. As also seen in FIG. 5, the end 52 of the elastic cord 50 can be affixed to the upper cross bar 30 by means of a screw 54 or other device that extends from the upper cross bar 30. The end 52 of the elastic cord 50 can therefore preferably be formed as a loop and easily be attached and detached from the screw 54 by simply slipping the loop over the screw 54 or removing the loop therefrom. As the elastic cord 50 wears out, therefore, it is easily replaceable without any difficulty or tools required for such removal and replacement.

Figure 6:
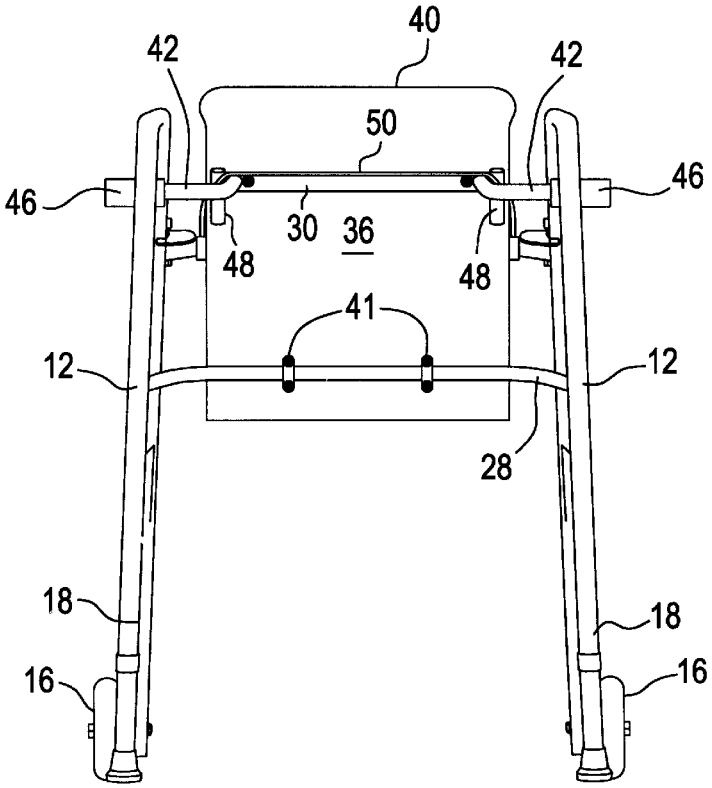
FIG. 6 is a rear view of the seated walker constructed in accordance with the present invention.

Finally, in FIG. 6 there is shown a rear view of the seated walker 10 and again showing the positioning of the elastic cord 50 around the free side 40 of seat 36 by encircling that free side 40 and the elastic cord 50 rides over the tubular bars 48 to prevent the elastic cord 50 from rubbing against the material of the seat 36.

It is understood that the invention is not limited to the illustrations described and shown herein, which are deemed to be merely illustrative of the best modes of carrying out the invention, and which are suitable of modification of form, size, arrangement of parts and details of operation. The intention rather is intended to encompass all such modifications which are within the spirit and scope and defined by the claims.

I claim:

1. A seated walker comprising:

a frame including (1) a pair of inverted U-shaped members each having a pair of legs extending downwardly; and (2) a front cross bar affixed to said frame members and disposed therebetween to maintain said frame members in an upright position; a seat affixed to said frame, said seat being movable between an upper position wherein said seat is generally positioned in a vertical position and a lower position wherein said seat is generally horizontal to provide a seat for a user; an elastic member affixed to said frame, said elastic member being positioned on said frame so as to be attachable to and detachable from said seat, said elastic member, when attached to said seat, biases said seat toward said upper position, wherein each of said U-shaped members includes a side brace extending between said legs, and wherein said seat includes a pair of curved members extending downwardly to contact and be supported by said side braces when said seat is in said lower position, and wherein said curved members are generally L-shaped.

2. A seated walker comprising;

a frame including: (1) a pair of inverted U-shaped members each having a pair of legs extending downwardly; (2) a front cross bar affixed to said members and disposed therebetween to maintain said U-Shaped members in an upright position; a seat affixed to said frame, said seat being movable between an upper position wherein said seat is generally positioned in a vertical position and a lower position wherein said seat is generally horizontal to provide a seat for a user; an elastic member affixed to said frame, said elastic member being positioned on said frame so as to be attachable to and detachable from said Beat by a user's hand, said elastic member, when attached to said seat, biases said seat toward said upper position, wherein each of said pair of U-shaped members includes a side brace extending between said legs at a height below said front cross bar, and wherein said seat includes a pair of curved members extending downwardly, said pair of curved members having a vertical height which corresponds to a distance between said front cross bar and an upper surface of each said side brace so as to support said seat in a generally horizontal plane in said lower position.

3. A seated walker as defined in claim 2 wherein said curved members are generally L-shaped.

4. A seated walker as defined in claim 3 wherein said elastic member is an elastic cord that is affixed to said front cross bar and is attachable to said seat by encircling at least a portion of said seat.

5. A seated walker as defined in claim 4 wherein said elastic cord has two ends affixed to said front cross bar and said portion of said elastic cord intermediate said two ends is adapted to encircle at least a portion of said seat.

6. A seated walker as defined in claim 2 wherein said seat is pivotally affixed to said front cross bar.

7. A seated walker as defined in claim 1 wherein said seat including a wearable surface for the comfort of the user and a protective bar adapted to be engaged by said elastic member to prevent said elastic member from rubbing on said wearable surface as said seat moves between said upper and said lower positions.

8. A seated walker as defined in claim 2 wherein said elastic member is in contact with said curved members when said seat is biased toward said upper positions and said elastic member is not in contact with said curved members when said seat is unbiased.

9. A seated walker comprising, a frame including (1) a pair of inverted U-shaped members each having a pair of legs extending downwardly; side braces interconnecting said legs of each of said pair of U-shaped members; a front cross bar affixed to said U-shaped members and disposed therebetween to maintain said U-shaped members in an upright position; a seat pivotally affixed to said frame, said seat being movable between an upper position wherein said seat is generally positioned in a vertical position and a lower position wherein said seat is positioned generally horizontal to provide a seat for a user; at least one tubular member extending outwardly from said seat, said at least one tubular member adapted to be supported by one of said braces when said seat is in said lower position, and at least one tubular member having a finite distance between said seat and said side brace supporting said at least one tubular member to orient said seat at a greater height above the ground than said brace supporting said at least one tubular member side when said seat is in said lower position.

10. A seated walker as defined in claim 9 wherein said at least one tubular member comprises two curved L-shaped members.

11. A seated walker as defined in claim 9 wherein said seat is pivotally affixed to said front cross bar.

12. A seated walker as defined in claim 9 wherein said seat is biased toward its upper position.

13. A seated walker as defined in claim 12 wherein said seat is biased by means of an elastic cord having its ends affixed to said front cross bar and encircling said seat.

14. A seated walker as defined in claim 13 wherein said elastic cord is in contact with said at least one tubular member when said seat is biased toward said upper position and said elastic cord is not in contact with said at least one tubular member when said seat is unbiased.

* * * * *